US008065774B2

(12) United States Patent
Schiesz et al.

(10) Patent No.: US 8,065,774 B2
(45) Date of Patent: Nov. 29, 2011

(54) PAINT BRUSH WITH DETACHABLE HEAD

(75) Inventors: Louis B. Schiesz, Fishers, IN (US); Christopher E. Haigh, Chicago, IL (US); Matthew Scott Graham, Noblesville, IN (US); Troy Daniel Mason, Brownsville, IN (US)

(73) Assignee: Margco International, LLC, Indianapolis, IN (US)

( * ) Notice: Subject to any disclaimer, the term of this patent is extended or adjusted under 35 U.S.C. 154(b) by 0 days.

(21) Appl. No.: 12/556,395

(22) Filed: Sep. 9, 2009

(65) Prior Publication Data

US 2010/0017986 A1 Jan. 28, 2010

Related U.S. Application Data

(63) Continuation of application No. PCT/US2008/078045, filed on Sep. 28, 2008, which is a continuation-in-part of application No. 11/923,986, filed on Oct. 25, 2007.

(60) Provisional application No. 60/863,029, filed on Oct. 26, 2006.

(51) Int. Cl.
*B25G 3/00* (2006.01)
*A46B 7/04* (2006.01)

(52) U.S. Cl. ..... 15/145; 15/143.1; 15/144.1; 15/172; 15/176.1; 15/176.6; 16/422; 16/430; 16/900; 403/92; 403/96; 403/97

(58) Field of Classification Search ..... 15/143.1, 15/144.1, 145, 172, 176.1, 176.6; 16/422, 16/430, 900, DIG. 24, DIG. 41; 403/92, 403/93, 96, 97
See application file for complete search history.

(56) References Cited

U.S. PATENT DOCUMENTS

| | | | |
|---|---|---|---|
| 555,854 | A | 3/1896 | Davenport |
| 727,035 | A | 5/1903 | Van Loan |
| D51,641 | S | 1/1918 | Hargrave |
| 1,787,970 | A | 1/1931 | Bertola |
| 2,032,664 | A | 3/1936 | Raptis |
| 2,066,328 | A | 1/1937 | Cameron |
| 2,147,310 | A | 2/1939 | Morrison |
| 2,175,278 | A | 10/1939 | Orebaugh |
| 2,389,882 | A | 11/1945 | Wood, Jr. |
| 2,395,245 | A | 2/1946 | Booharin |
| 2,526,756 | A | 10/1950 | Krebs |
| 2,528,599 | A | 11/1950 | Loether |
| 2,558,290 | A | 6/1951 | Brown et al. |
| D167,775 | S | 9/1952 | Schmidt |

(Continued)

FOREIGN PATENT DOCUMENTS

| | | |
|---|---|---|
| BE | 497801 | 12/1950 |

(Continued)

OTHER PUBLICATIONS

PCT/US2008/78045, Internationai Search Report, Feb. 12, 2008, Haigh, et al.

(Continued)

*Primary Examiner* — Mark Spisich
(74) *Attorney, Agent, or Firm* — Kreig DeVault LLP

(57) ABSTRACT

A paint brush has a handle and a paint brush head. The paint brush head is detachable from the paint brush handle. The paint brush head may be rotatable to a number of positions relative to the paint brush handle.

14 Claims, 12 Drawing Sheets

U.S. PATENT DOCUMENTS 2,617,142 A 11/1952 Cadwell et al.
2,633,589 A 4/1953 Eisner et al.
2,712,765 A 7/1955 Knight, Jr.
2,719,998 A 10/1955 Hibbs
2,817,107 A 12/1957 Zellinger
2,838,835 A 6/1958 Jepson
2,910,770 A 11/1959 Kachline
3,027,582 A 4/1962 Pittman
D199,520 S 11/1964 Jones
3,273,192 A 9/1966 Mazzella
3,353,203 A * 11/1967 Ginter ..... 15/244.1
3,367,578 A 2/1968 Juvinall et al.
D212,668 S 11/1968 Miller
3,498,546 A 3/1970 Logan et al.
3,548,593 A 12/1970 Valdespino
3,596,304 A 8/1971 Welt
3,673,684 A 7/1972 Muntz
3,717,896 A 2/1973 Chase et al.
3,737,187 A 6/1973 Pryor
3,757,376 A 9/1973 Coombes
3,866,257 A 2/1975 Cansdale, Sr.
3,874,021 A 4/1975 Jacobs
3,893,242 A 7/1975 Lieb et al.
D240,678 S 7/1976 Herig
4,018,076 A 4/1977 Wagner
RE29,311 E 7/1977 Ritter
D255,845 S 7/1980 Wood
4,311,404 A 1/1982 Kodera
D269,588 S 7/1983 Ludwig
4,469,223 A 9/1984 Smith
4,494,268 A 1/1985 Chu
D279,254 S 6/1985 Smith et al.
4,577,367 A 3/1986 Durand
4,621,770 A 11/1986 Sayen
4,658,461 A * 4/1987 Roe et al. ..... 15/210.1
4,819,294 A * 4/1989 Calvert ..... 15/209.1
D303,921 S 10/1989 Blochlinger et al.
4,936,702 A 6/1990 Hsu
4,956,892 A 9/1990 Fawkes
5,207,755 A 5/1993 Ampian
5,226,198 A 7/1993 Martin
5,366,314 A 11/1994 Young
5,375,286 A 12/1994 Harrah
5,499,637 A 3/1996 Foti
5,502,859 A 4/1996 Kim
5,520,073 A 5/1996 Bakula et al.
D371,002 S 6/1996 Berti
5,577,654 A 11/1996 Bishop
5,638,577 A 6/1997 Gooding et al.
D388,684 S 1/1998 Irwin
5,752,619 A 5/1998 Fulton
5,802,658 A 9/1998 Ward
5,902,065 A 5/1999 Forestiero et al.
5,903,952 A 5/1999 Camp, Jr. et al.
5,926,903 A 7/1999 Kim
D413,445 S 9/1999 deBlois et al.
D413,784 S 9/1999 Tsai
D414,672 S 10/1999 Tsai
D416,390 S 11/1999 Corriveau
5,992,423 A * 11/1999 Tevolini ..... 132/200
6,029,307 A * 2/2000 Baudoin ..... 15/145
6,035,481 A 3/2000 Douglas et al.
D429,072 S 8/2000 Winge
6,119,311 A 9/2000 Lavallee
D432,891 S 10/2000 Sterling
6,138,313 A * 10/2000 Barton et al. ..... 15/143.1
6,148,467 A 11/2000 Martinsson
D439,334 S 3/2001 Hershberger et al.
6,213,667 B1 4/2001 Isaac
6,230,357 B1 * 5/2001 Davis ..... 15/176.3
6,230,716 B1 5/2001 Minoletti
6,262,693 B1 7/2001 Sutter et al.
6,301,740 B1 * 10/2001 Quiroz ..... 15/172
6,345,406 B1 2/2002 Dodd
6,363,578 B1 4/2002 Chang
6,408,479 B1 6/2002 Pinney
D459,645 S 7/2002 Rothfus et al.
6,438,784 B1 8/2002 Yu
6,438,797 B1 8/2002 Thomas
6,473,929 B1 11/2002 Learned, III
D468,618 S 1/2003 Ho
6,502,585 B1 * 1/2003 Mazzei et al. ..... 132/237
6,510,578 B1 1/2003 Cyr et al.
6,546,585 B1 4/2003 Blaustein et al.
D474,949 S 5/2003 Schaffeld et al.
6,557,212 B2 5/2003 Huang
6,681,436 B2 1/2004 Nilsson
D495,145 S 8/2004 Gladden
D501,324 S 2/2005 Berti
6,880,253 B1 4/2005 Gyllerstrom
D527,531 S 9/2006 Fruin
D544,331 S 6/2007 Blehm
D565,920 S 4/2008 Bagley
D578,771 S 10/2008 Bagley
7,472,447 B2 1/2009 Lougheed
2001/0025421 A1 10/2001 Damstra
2002/0148058 A1 10/2002 Greenwood et al.
2002/0178586 A1 12/2002 Oswald
2003/0005533 A1 * 1/2003 Woodnorth et al. ..... 15/143.1
2003/0217424 A1 11/2003 Stone
2003/0221318 A1 12/2003 Iwashita et al.
2004/0083865 A1 5/2004 Stevens
2004/0178223 A1 9/2004 Foster et al.
2004/0231083 A1 11/2004 Zaksenberg
2006/0037162 A1 2/2006 McRay
2007/0157406 A1 7/2007 Kim
2007/0251041 A1 11/2007 Errichiello et al.
2007/0294849 A1 12/2007 Bagley

FOREIGN PATENT DOCUMENTS

DE 916406 8/1954
DE 19742286 4/1998
DE 19837988 2/2000
DE 10006788 8/2001
EP 640303 3/1995
FR 714282 11/1931
FR 894974 3/1944
FR 2428418 1/1980
FR 2624766 6/1989
GB 606536 12/1945
GB 886285 5/1958
GB 2259474 * 3/1993
GB 2301307 12/1996
GB 2381189 4/2003
GB 2403448 * 1/2005
IT 429280 3/1947

OTHER PUBLICATIONS

U.S. Appl. No. 11/923,986, Schiesz et al., filed Oct. 25, 2007, Office Action dated Nov. 22, 2010.

PCT/US2008/078045 International Preliminary Report on Patentability and Written Opinion dated Apr. 27, 2010 from the International Searching Authority.

* cited by examiner

PAINT BRUSH WITH DETACHABLE HEAD

RELATED APPLICATIONS

The present application is a continuation of PCT/US2008/078045 filed on Sep. 28, 2008, which is a continuation-in-part of U.S. patent application Ser. No. 11/923,986, filed Oct. 25, 2007 which in turn claims the benefit of U.S. Provisional Application No. 60/863,029, filed on Oct. 26, 2006, each of which is incorporated herein by reference.

FIELD OF THE INVENTION

This invention relates to a paint brush, and more particularly to a paint brush having a detachable paint brush head.

BACKGROUND OF THE INVENTION

Paint brushes are well known and are useful in a number of applications. However, once a common paint brush is used, it is typically necessary to either clean the paint off of the paint brush, or in the alternative, throw the paint brush away.

Moreover, the common paint brush is typically formed so that the handle is in the same plane (i.e. axially aligned) with the brush head. While this alignment may be suitable for some uses, it can be limiting and not as suitable or comfortable for a user in other uses.

SUMMARY OF THE INVENTION

The present invention relates to a paint brush that has a handle and a detachable paint brush head. The handle can be formed for comfort in a user's hand, such as being contoured to fit in a person's palm and have contoured portions for receiving the fingers of the person. The handle could also be formed to fit either a left-handed person or a right-handed person.

The handle may also be formed at an angle relative to the brush head, so that a user's wrist need not conform to the longitudinal axis of the paint brush. The handle may also pivot relative to the brush, thereby giving a user a plurality of options for positioning of the brush head relative to the handle.

In one embodiment, a handle is coupled to a brush head using at least one groove-and-tab connector. The groove-and-tab connector could be configured to permit coupling of the handle and brush head in a number of positions.

In another embodiment of the present invention, a handle is coupled to a brush head using a selectable engagement device. The selectable engagement device has a first position wherein the brush head can be engaged or disengaged from the handle. The selectable engagement device also has a second position wherein the brush head can be locked in place relative to the handle.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
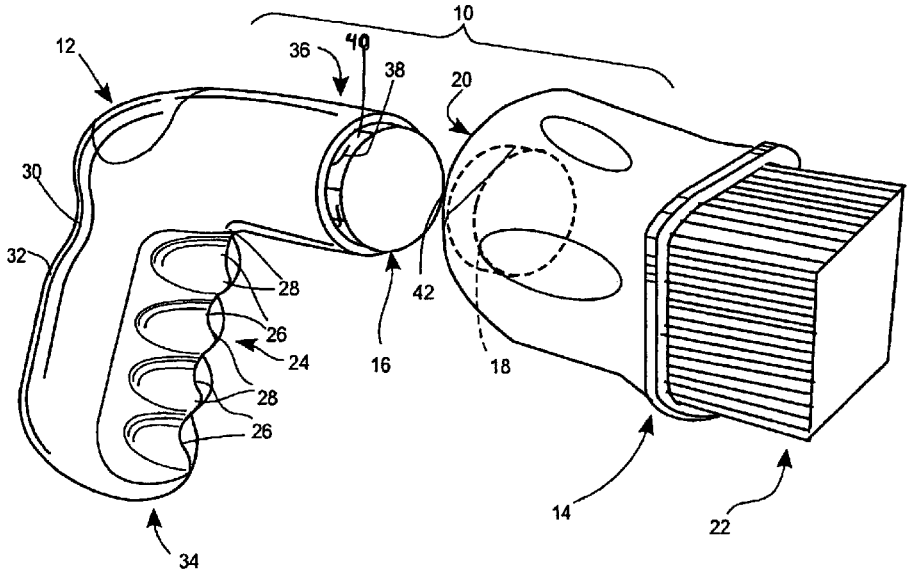
FIG. 1 is an elevation view of a paint brush having a handle that is detachable and a brush head.

FIG. 1 illustrates a paint brush apparatus 10 having a handle 12 and a brush head 14. Handle 12 is illustratively formed to have a protrusion 16 that is configured to mate with recess 18 formed in connecting end 20 of brush head 14. Brush head 14 also has a brush end 22 that provides filaments or hairs for use in applying paint to a surface. It should be understood that although the illustrations show a fairly broad brush of a width considerably larger than that of the handle 12, other brush head shapes and modifications are within the scope of the disclosure, and brush head 14 may have a differently shaped or smaller profile. In addition, other materials may be substituted for brush head 14, such as foam applicators, cloth applicators, sponges, and the like.

Handle 12 illustratively includes a contoured finger-grip surface 24 having a plurality of finger-receiving recesses 26. In the illustrated embodiment, finger-receiving recesses 26 cooperate with a plurality of rims 28 positioned therebetween so as to form a grip that is comfortable and substantially conforms to the contours of a human hand. As illustrated, a contoured surface 30 may also be provided on the palm-side surface 32 of handle 12. Handle 12 may also be configured to fit either a left-handed grip or a right-handed grip by having an exterior surface that is contoured to the corresponding grip.

Although FIG. 1 shows a handle 12 that is substantially formed in a 90-degree angle, it should be understood that other configurations are within the scope of the disclosure. Such configurations may be implemented as required by the particular use. For example, it may be advantageous for a handle 12 to have a less than 90-degree angle in certain applications. This configuration may be desirable for greater comfort, and/or for ease in accessing the area to be painted. In the alternative, handle 12 may be configured to have a pivotable angle (not shown), which would allow for a range of angles between grip portion 34 and engagement portion 36.

In the embodiment illustrated in FIG. 1, protrusion 16 is cylindrically shaped and has a smaller outer diameter than engagement portion 36. Protrusion 16 extends outwardly away from engagement portion 36 a sufficient length to permit a secure connection between male protrusion 16 and female connecting end 20 of brush head 14.

Connecting end 20 of brush head 14 is illustratively formed to have a cylindrically shaped recess 18, the recess being configured to receive male protrusion 16. Protrusion 16 has at least one groove 38 formed in the external surface 40 of protrusion 16. Groove 38 is configured to receive a tab 42 that is illustratively positioned on the interior of cylindrically shaped recess 18. Multiple tabs 42 may also be placed along the interior of cylindrically shaped recess 18 in order to mate with a protrusion having a plurality of grooves 38. Of course, it should be understood that paint brush apparatus 10 may be configured such that protrusion 16 is located on brush head 14 and recess 18 is located on handle 12.

If a plurality of groove 38 and tab 42 combinations are used, as shown in FIG. 1, brush head 14 can be connectable with handle 12 in a number of orientations. For example, brush head 14 could be aligned with handle 12 in the manner shown in FIG. 1, where brush head 14 is substantially co-planar with handle 12. In the alternative, however, brush head 14 could be rotated relative to handle 12 such that tabs 42 each align with a different groove, permitting alignments of brush head 14 and handle 12 that are not co-planar. Such varying alignments may be desirable for projects which are better facilitated by having a different angle of attack for the brush head 14.

Figure 2:
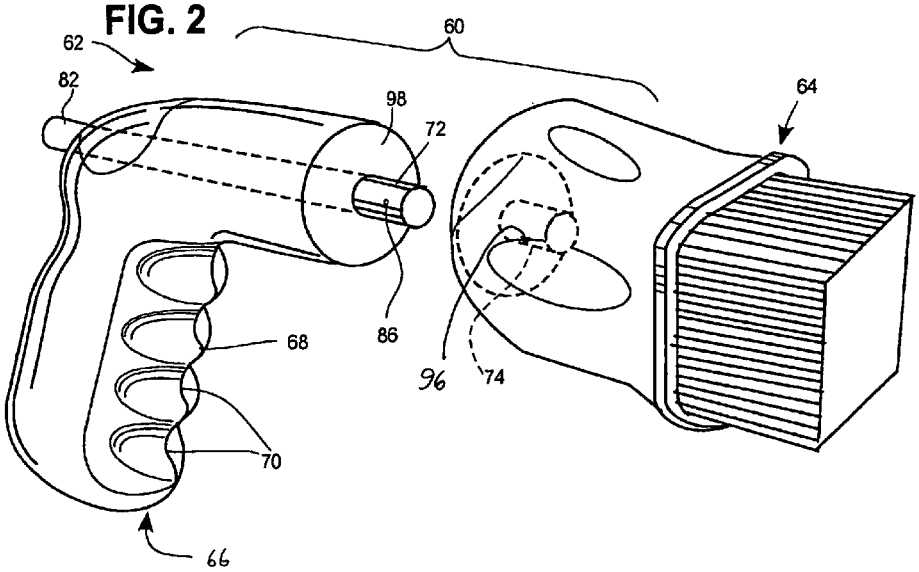
FIG. 2 is an elevation view of another embodiment of a paint brush having a handle that is detachable and a brush head.

Another embodiment is shown in FIG. 2, wherein a paint brush apparatus 60 comprises a handle 62 and a brush head 64. In the embodiment shown in FIG. 2, a grip portion 66 can be configured similarly to grip portion 34 of handle 12 in FIG. 1. For example, grip portion 66 of FIG. 2 may include finger-receiving recesses 70 that are bounded by rims 68. Furthermore, grip portion 66 may be configured to fit either a left hand or a right hand of a user.

Figure 3:
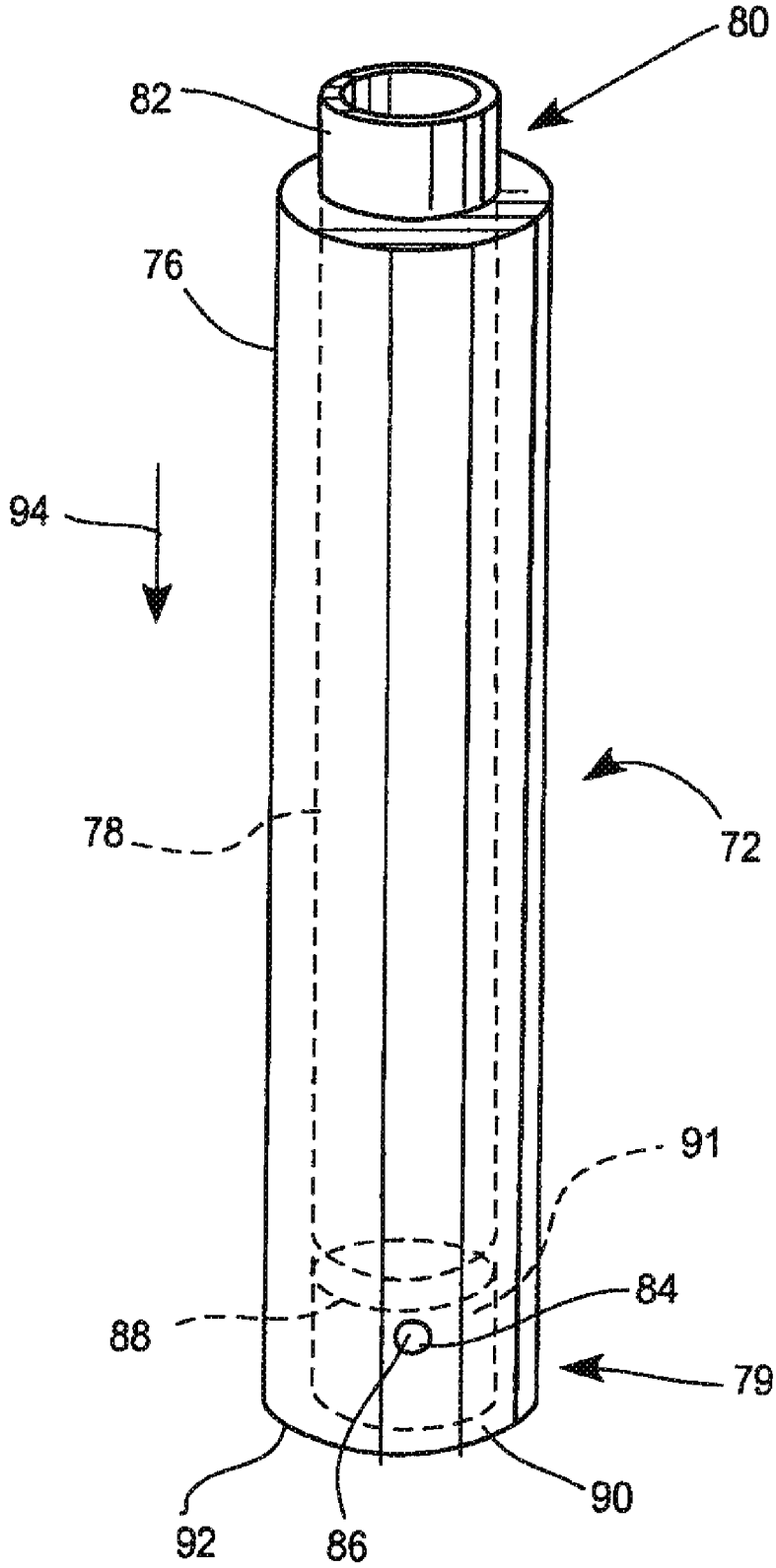
FIG. 3 is an elevation view of a selectable engagement device useful in detachably securing the paint brush handle to the brush head.

In the embodiment disclosed in FIG. 2, handle 62 and brush head 64 are connectable via selectable engagement device 72 and receiver 74. Selectable engagement device 72 is illustratively a cylindrical tube 76 having a movable rod 78 disposed therein, as can be seen in FIG. 3. Selectable engagement device 72 has a button end 80 housing a button 82 (visible in FIGS. 2 and 3). In the illustrated embodiment, button 82 is an exposed end of movable rod 78. The opposite, engagement end 79 of selectable engagement device 72 is enclosed and contains at least one aperture 84. A ball bearing 86 is positioned inside cylindrical tube 76 such that a portion of the ball bearing 86 extends outwardly through aperture 84. Outer surface 91 of rod 78 engages ball bearing 86, holding it in place against aperture 84.

A chamber 88 circumscribes rod 78, and a spring 90 is positioned between end cap 92 of cylindrical tube 76 and rod 78, thereby maintaining a bias against rod 78 to naturally predispose rod 78 in the position shown in FIG. 3. When button 82 is depressed, rod 78 moves in the direction indicated by arrow 94, depressing spring 90 against end cap 92. Such movement aligns chamber 88 with aperture 84, thereby allowing ball bearing 86 to partially recess inside chamber 88 and thereby not protrude as far through aperture 84. In this position, selectable engagement device 72 can be engaged or disengaged with receiver 74. Once selectable engagement device 72 is engaged with receiver 74 (and therefore handle 62 and brush head 64 are engaged), button 82 can be released, so as to cause ball bearing 86 to engage an inner surface 96 of receiver 74. In order to accommodate ball bearing 86, inner surface 96 may be fitted with a chamber or dimple (not shown) that receives ball bearing 86, or any similar type of construction that permits a locking engagement between selectable engagement device 72 and receiver 74. It is also contemplated that inner surface 96 may alternatively be formed of a malleable or other type of material that would allow for ball bearing 86 to imbed in inner surface 96 and thereby retain selectable engagement device 72 inside receiver 74.

A positioned (not shown) may also be used to facilitate engagement between handle 62 and brush head 64. Such a positioned may comprise, for example, matching engageable teeth that are formed on each of the surfaces of the handle 62 and brush head 64. The engageable teeth would be positioned such that when handle 62 and brush head 64 are engaged, the teeth would engage and therefore lock the rotational position of the brush head 64 in place relative to the handle 62. The teeth may be positioned, for example, on engagement surface 98 of handle 62 and on the opposing engagement surface of brush head 64. Another alternative construction is to place the teeth on or near end cap 92 of selectable engagement device 72, and mating teeth inside receiver 74.

In either embodiment, it may further be desirable to incorporate a paint feed tube, or some other means of introducing paint to the brush head. For example, it may be desirable to have a paint feed tube that passes through the handle to feed paint to the paint brush head. The paint feed tube may be connected to a paint supply, or even a pressurized paint supply, that would provide a constant source of paint to the brush head. In the embodiment shown in FIGS. 2 and 3, such a paint feed tube may be configured to pass through the center of rod 78. However, other configurations are within the scope of the disclosure.

In yet another embodiment, a paint brush handle 100 and heads 102, 104, 105 are disclosed in FIGS. 4-8. Paint brush handle 100 is illustratively formed of two substantially symmetric halves 106, 108, and the two halves are fastened with at least one fastener. A grip coating 110 is also disclosed, the grip being of a material that provides both comfort and utility as a grip. Such a material for the grip coating 110, for example, may be a polymer or rubberized type of material that is long-lasting and durable, yet has some flexibility so as to feel comfortable in the hand.

Figure 4:
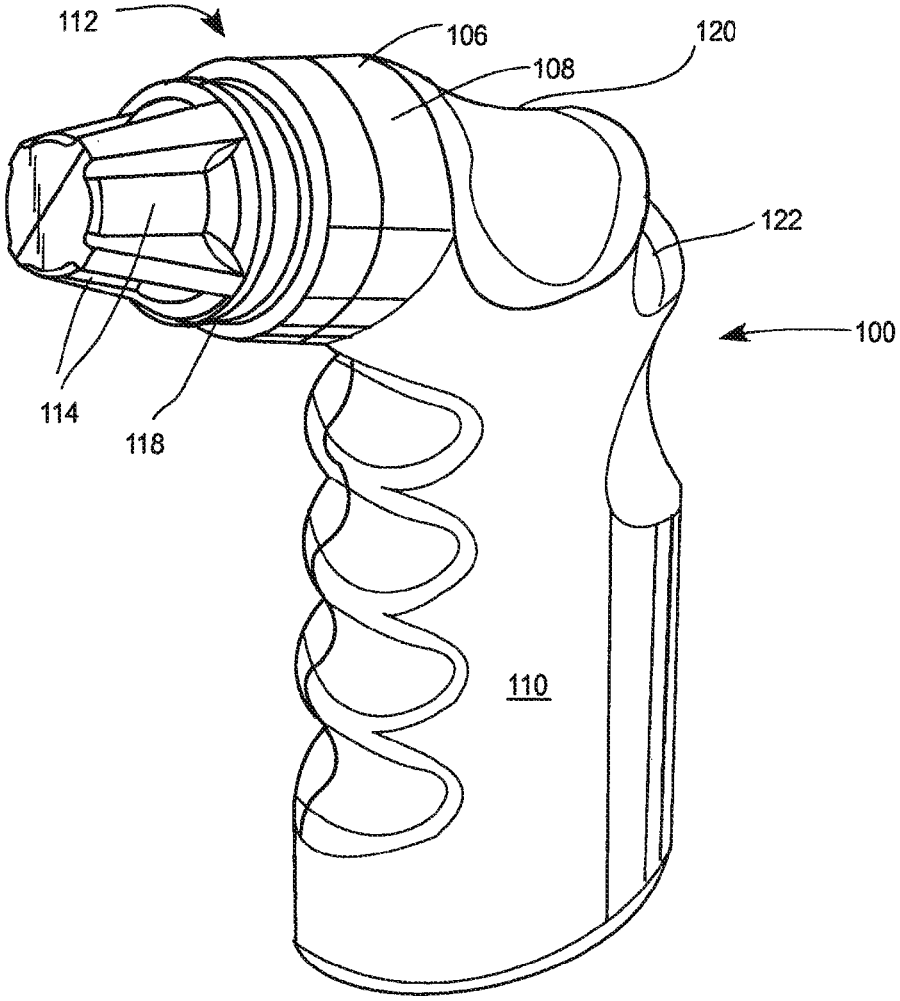
FIG. 4 is a perspective view of another embodiment of the paint brush handle of the present invention.
Figure 5:
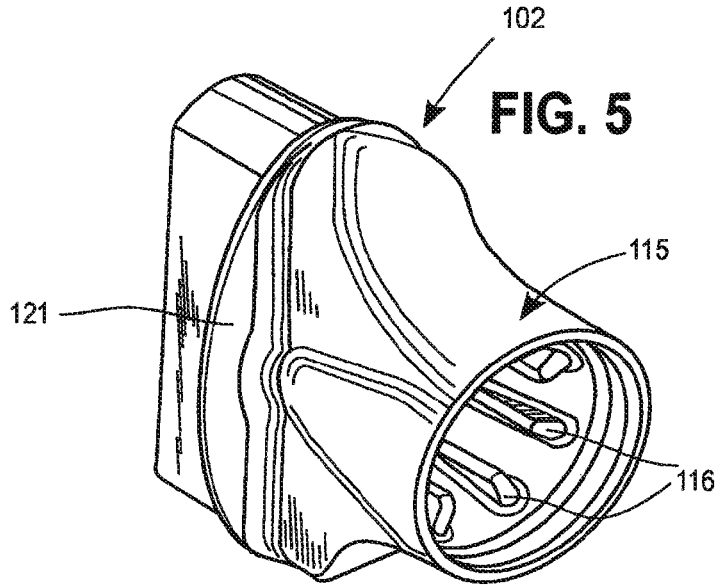
FIG. 5 is a perspective view of another embodiment of the paint brush head associated with the present invention.
Figure 6:
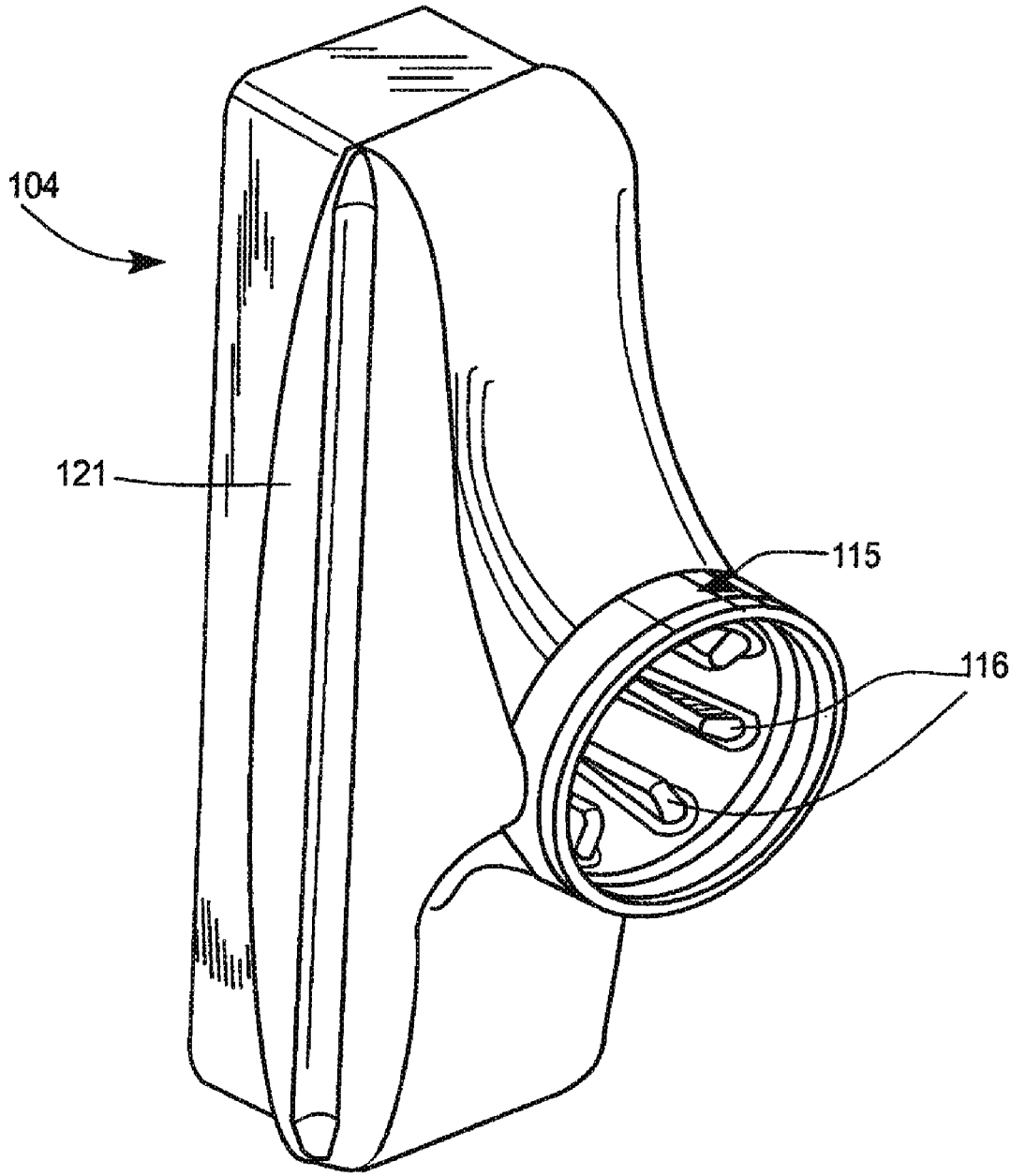
FIG. 6 is a perspective view of yet another embodiment of the paint brush head associated with the present invention.
Figure 7:
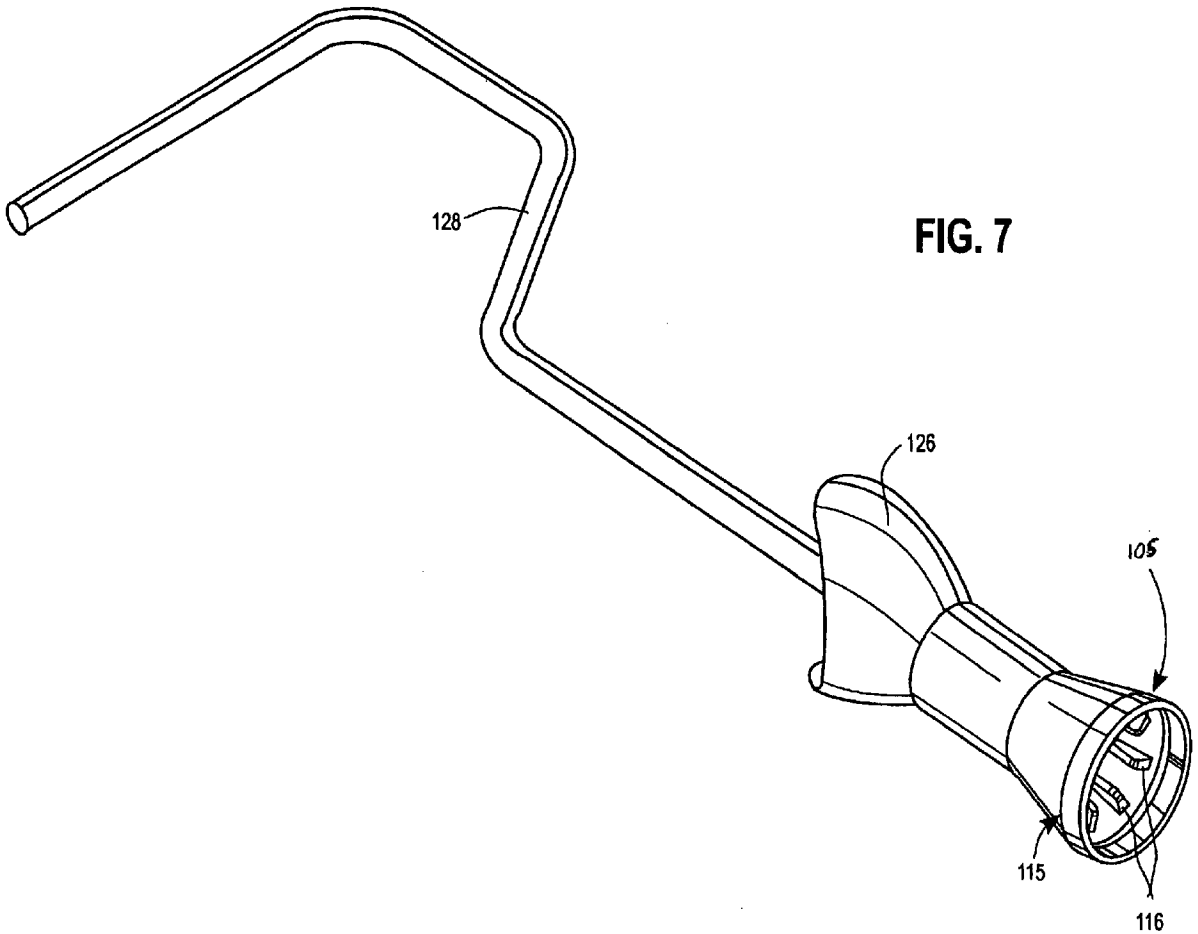
FIG. 7 is a perspective view of a paint brush roller head associated with the present invention.

As shown in FIG. 4, handle 100 can be configured to have an engagement portion 112 that mates with receiving portion 115 of brush heads 102, 104, 105, shown in FIGS. 5-7. Illustratively, engagement portion 112 has recesses 114 that can mate with tabs 116 of brush heads 102, 104, or 105. Recesses 114 cooperate with tabs 116 to create a mating relationship between handle 100 and a selected one of heads 102, 104, 105 such that head 102, 104 or 105 does not rotate relative to handle 100 when handle 100 and head 102 are engaged. Handle 100 also has a rim 118 that interlocks with head 102 to maintain the engagement between handle 100 and head 102.

Figure 8:
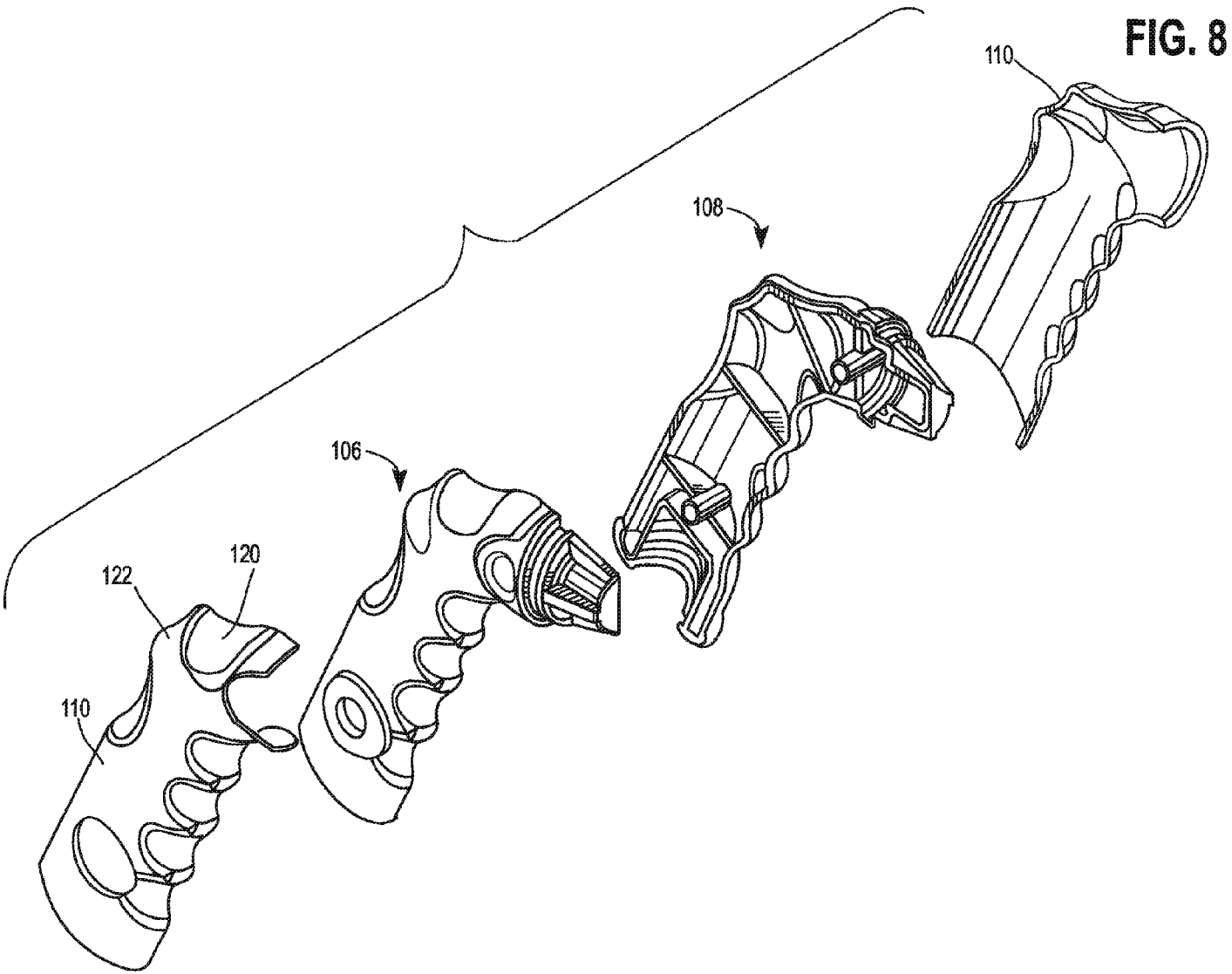
FIG. 8 is an exploded assembly view of a paint brush handle.

As can be seen in FIGS. 4 and 8, handle 100 is illustratively configured to include a first thumb notch 120 and a second thumb notch 122. The alternative positions for the thumb in notch 120 or 122 allows for a range of hand sizes and/or a range of desired grips for a user.

FIG. 5 is an example of one type of paint brush head 102 that can be engaged with handle 100. In the example shown in FIG. 5, paint brush head 102 holds a two inch paint brush. Such a two inch paint brush is well known in the art, and is readily formed and attached to head 102 via staples, glue, or any other type of fastener.

Yet another type of paint brush head 104 is shown in FIG. 6, wherein the paint brush head 104 holds a four inch brush. In the illustrated embodiments shown in FIGS. 5 and 6, brush heads 102 and 104 each include a protrusion 121 that provides a lip to facilitate easy detachment from handle 100.

It is contemplated that a roller head 105, such as that shown in FIG. 7, may also be attached to handle 100. Roller head 105 may include a paint catch 126 that functions to prevent paint from running down support 128 and on to handle 100. Illustratively, support 128 is made of metal and is attached to a plastic head 105. Similar to paint brush heads 102, 104, roller head 105 has a receiving portion 130 that engages engagement portion 112 of handle 100.

Figure 9:
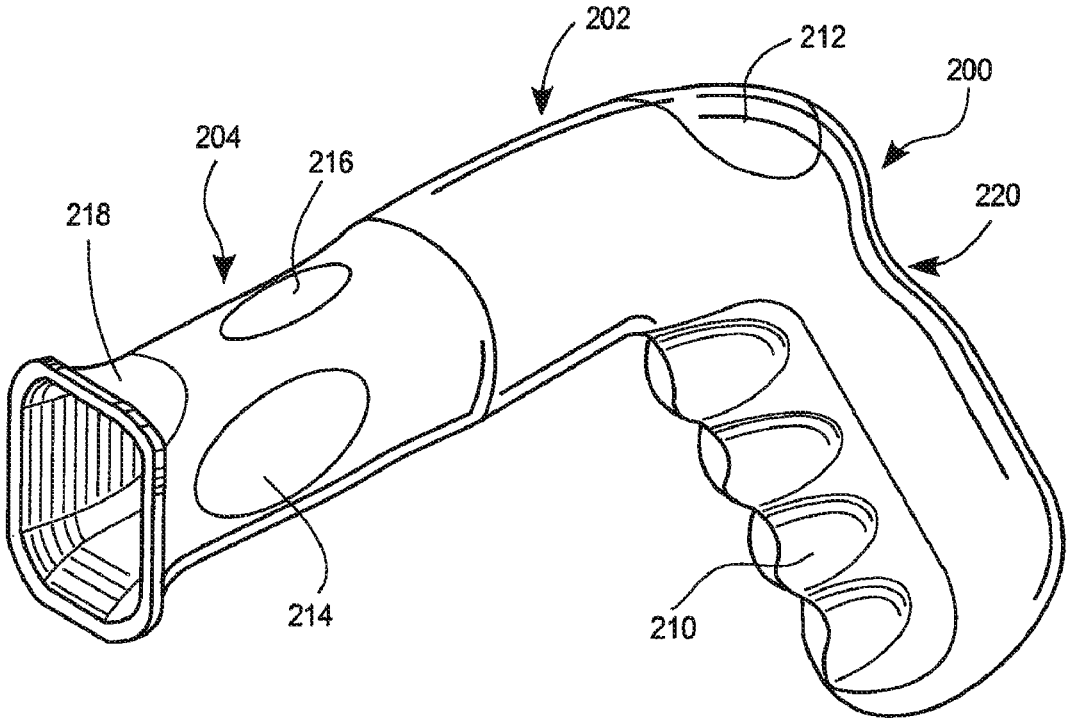
FIGS. 9-11 show perspective views of yet another embodiment of a paint brush handle, each of FIGS. 9-11 having a differently sized paint brush head attached to the paint brush handle.
Figure 10:
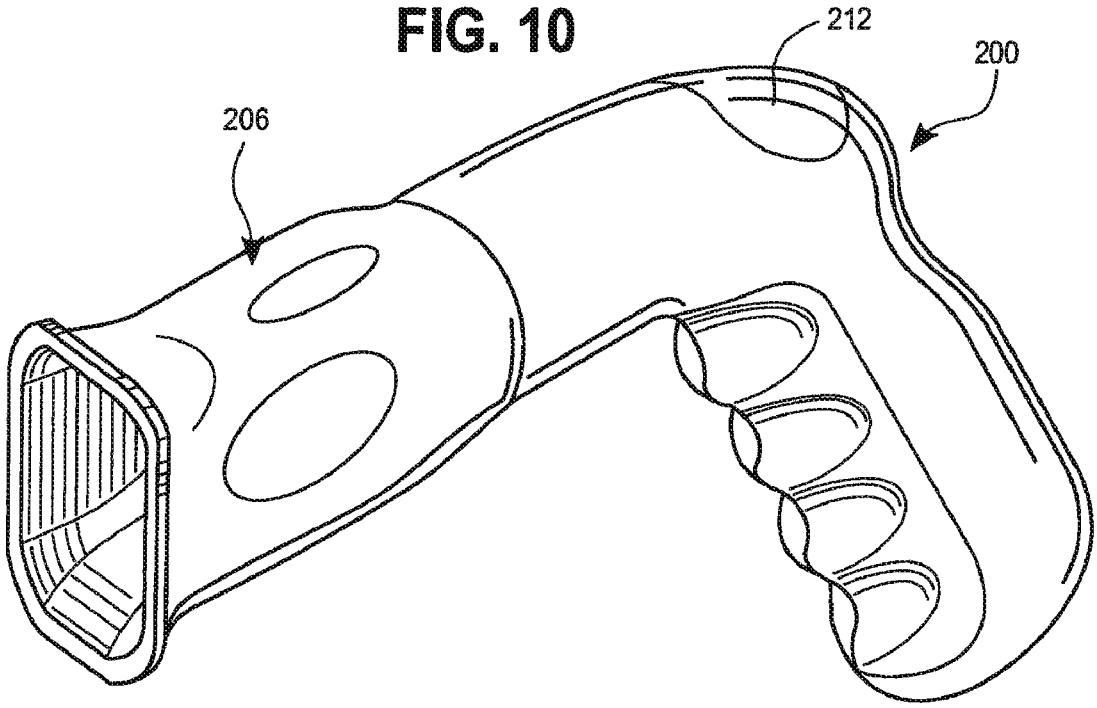
Figure 11:
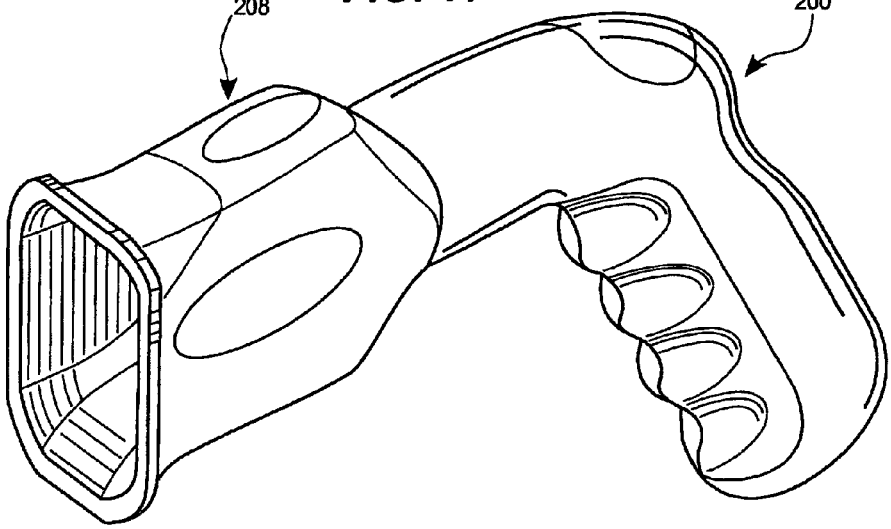

FIG. 9 shows yet another embodiment of a paint brush handle 200. In this embodiment, neck 202 of brush handle 200 is relatively shorter, thereby allowing a user to position his or her hand closer to the brush and consequently have more control over the stroke of the brush. Once again, paint brush head 204 is removable and replaceable with other types and sizes of paint brush heads 206, 208, as can be seen in FIGS. 10 and 11.

Illustratively, paint brush handle 200 has grip surfaces 210, 212 that can be formed from a different material, such as a rubberized material. Such a contrasting material may provide additional comfort and/or tackiness (assisting with grip) when a user is using the paint brush handle 200.

In one embodiment, portions or all of the paint brush apparatus 10 and other devices disclosed herein, in addition to the packaging for the same, can be made of recyclable and/or biodegradable materials. For example, materials such as those available from www.goodearthpkg.com may be used.

Paint brush heads 204, 206, 208 may also be configured to have grip surfaces 214, 216, 218. Such grip surfaces are contemplated to assist a user with both removal and placement of the paint brush head, as well as rotation of the paint brush head as discussed further herein. Paint brush handle 200 may also have a recess 220 that is positioned to receive a user's hand.

Figure 12:
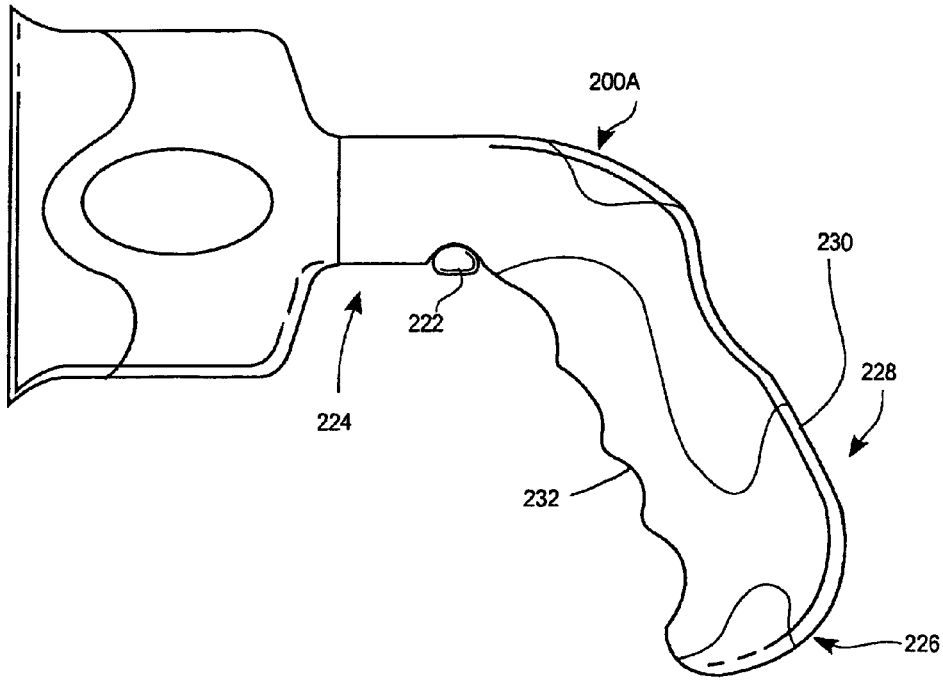
FIG. 12 is an elevation view of yet another embodiment of a paint brush handle.

As can be seen in FIG. 12, an alternative embodiment of paint brush handle 200A is disclosed. According to this embodiment, a button 222 can be positioned on a lower portion 224 of neck 202. The butt end 226 of paint brush handle 200 is formed to have a rounded portion 228 that also may have a grip surface 230 that extends from the finger groove portion 232. Although not shown, paint brush handle 200 of FIGS. 9-11 may also be configured to have a button 222.

Figure 13:
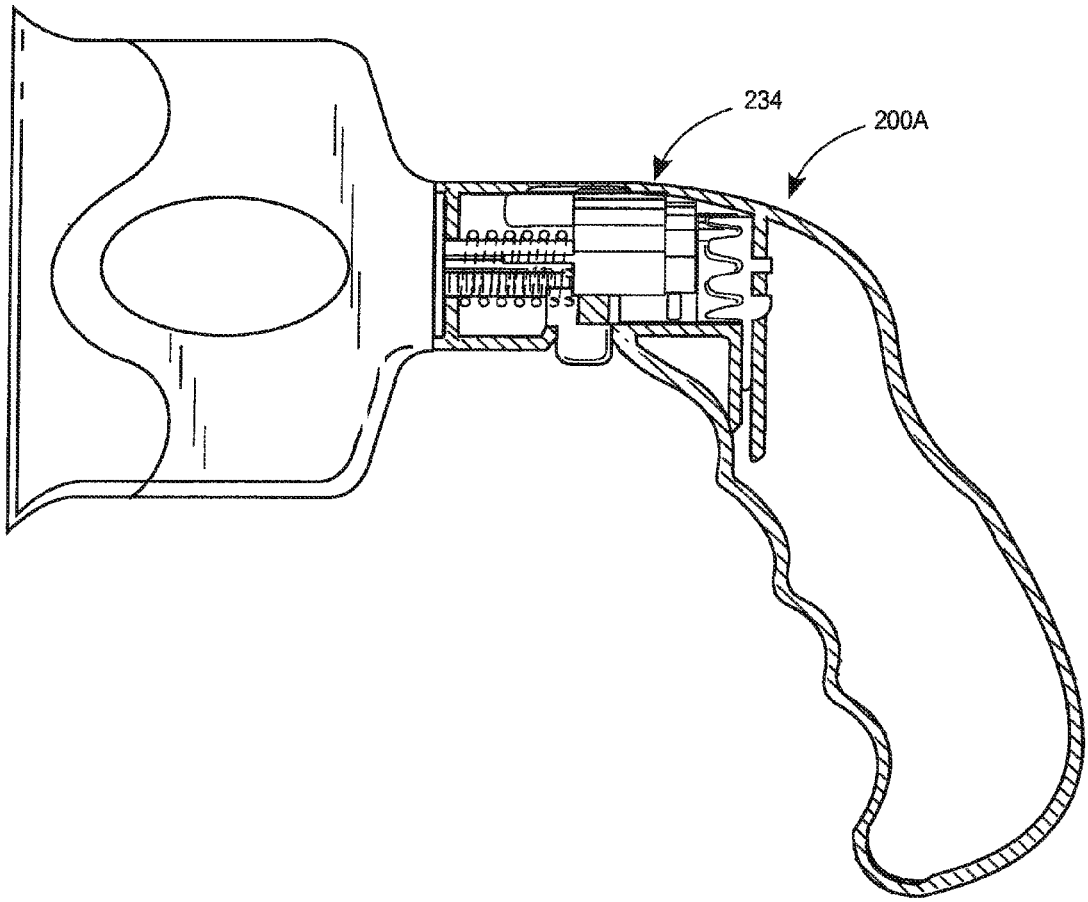
FIG. 13 is a cutaway view of the paint brush handle of FIG. 12, showing the attachment mechanism positioned within the paint brush handle that permits the attachment and detachment of various paint brush heads.

FIG. 13 shows a cutaway view of the paint brush handle 200A of FIG. 12. In the cutaway view, it can be seen that engagement mechanism 234. A closer view of engagement mechanism 234 and the operation thereof can be seen in FIGS. 14-17.

Figure 14:
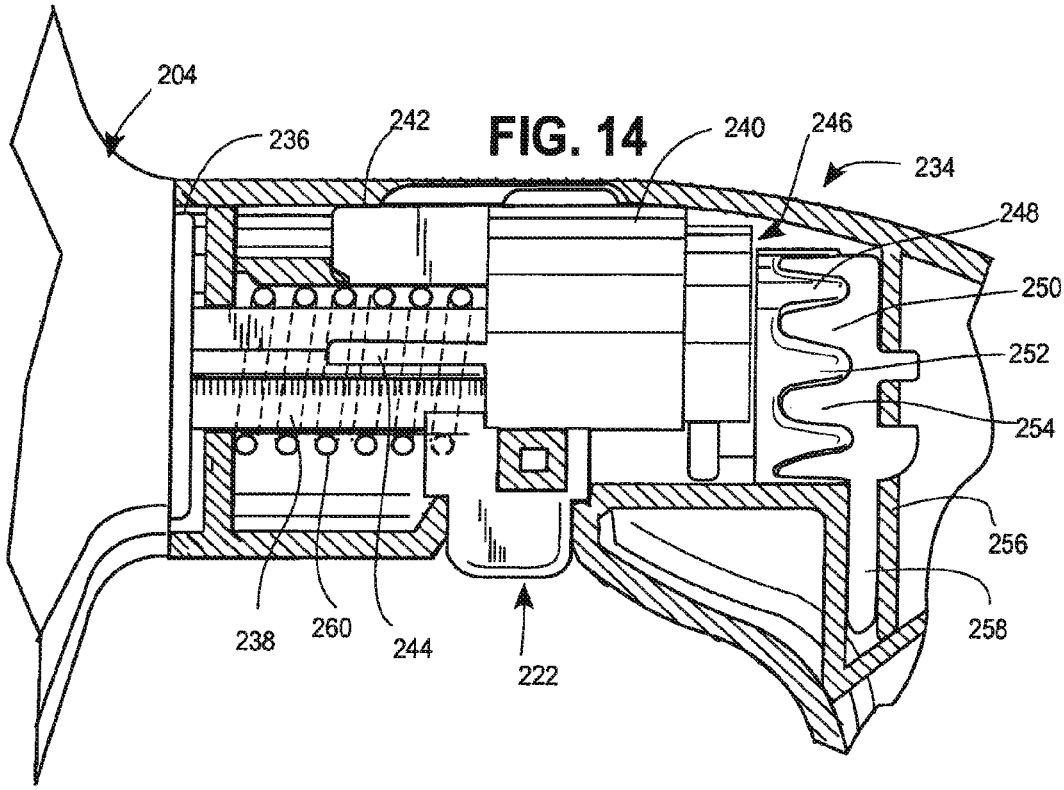
FIGS. 14-18 show enlarged cutaway views of the attachment mechanism in various positions of operation.

FIG. 14 illustrates the various components of engagement mechanism 234. According to the illustrated embodiment, paint brush head 204 (although other paint brush heads are similarly constructed and can be positioned in place of head 204) has an integral disc 236 and a plunger 238. Integral disc 236 is illustratively formed integrally with paint brush head 204. In the illustrated embodiment, plunger 238 is also formed integrally with paint brush head 204 and integral disc 236. Plunger 238 defines a longitudinal axis.

Figure 15:
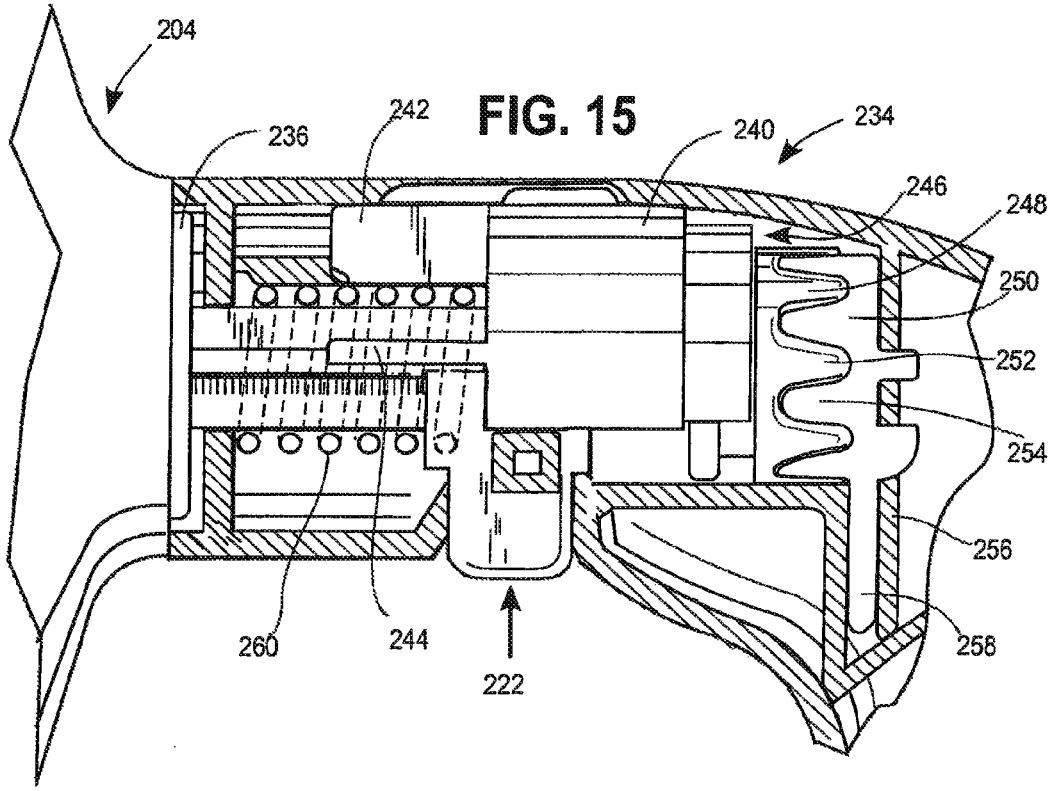

Engagement mechanism 234 also includes a carriage 240 that is configured to slide in a substantially coaxial direction along the longitudinal axis of plunger 238. Carriage 240 includes tabs 242, 244 that extend longitudinally toward brush head 204. On the opposite end 246 of carriage 240, carriage 240 is connected to first lock 248, which is in turn engaged with second lock 250. Illustratively, first and second locks 248, 250 have teeth 252, 254 formed thereon, such that teeth 252, 254 can be positioned to engage each other as shown in FIGS. 14-15, thereby substantially preventing rotary motion of carriage 240 and first lock 248 relative to second lock 250. Second lock 250 is positioned in a fixed relationship with housing component 256. A foot 258 also extends downwardly from second lock 250 to further secure it in housing component 256.

Figure 16:
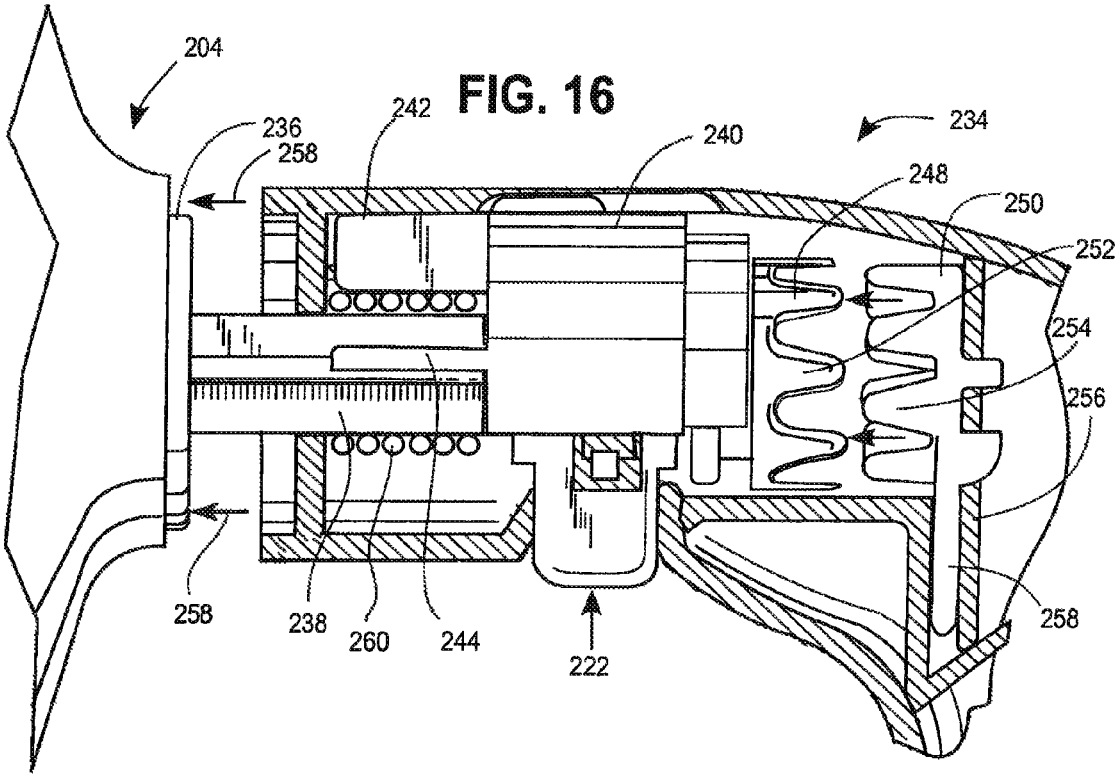

FIG. 16 shows a cutaway view of engagement mechanism 234, wherein paint brush head 204 has been pulled outwardly in the direction shown by arrows 258. Because plunger 238 is connected to paint brush head 204, and likewise carriage 240 is engaged with plunger 238, carriage 240 has also moved in the direction of arrows 258. Likewise, since first lock 248 is engaged with carriage 240, it has also moved with carriage 240 away from second lock 250. Accordingly, when a user pulls paint brush head 204 in the manner shown in FIG. 16, it causes first lock 248 to separate from second lock 250. The separation of first and second locks 248 and 250 permits first lock 248 to rotate relative to second lock 250. This rotation allows a user to reposition paint brush head 204 in an angle of rotation appropriate for the application or user. Once the desired angle of rotation is achieved, the user can release paint brush head so that first lock 248 returns to engagement with second lock 250. Spring 260 biases carriage 240 such that it causes first lock 248 to engage second lock 250 absent action from a user.

Figure 17:
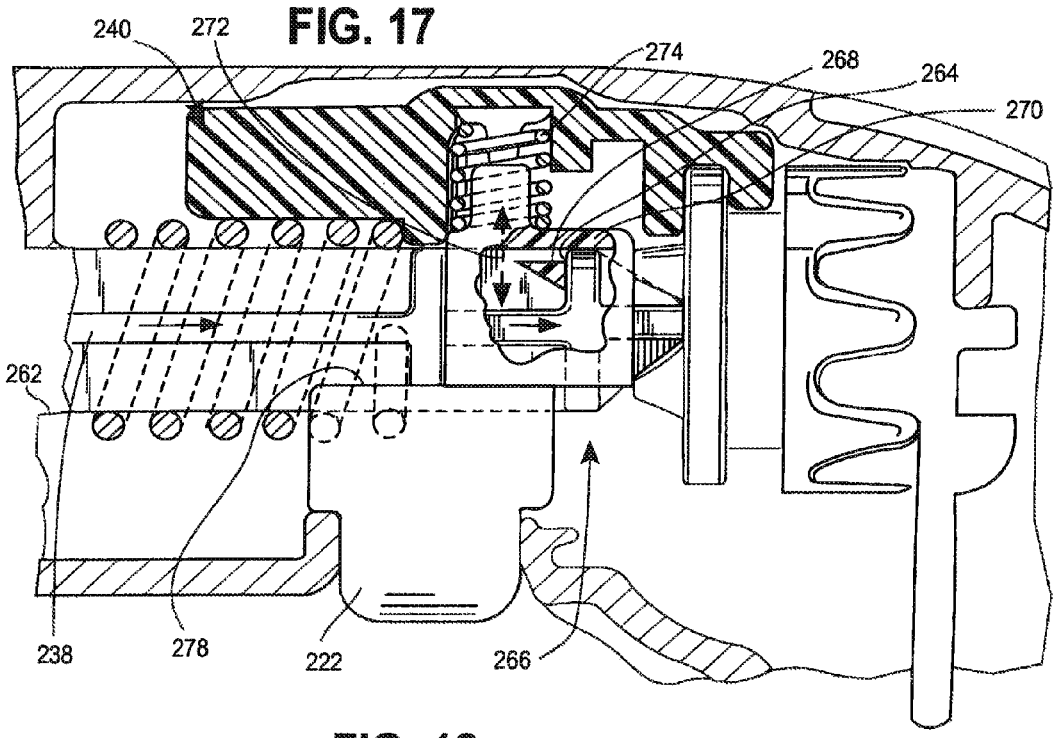
Figure 18:
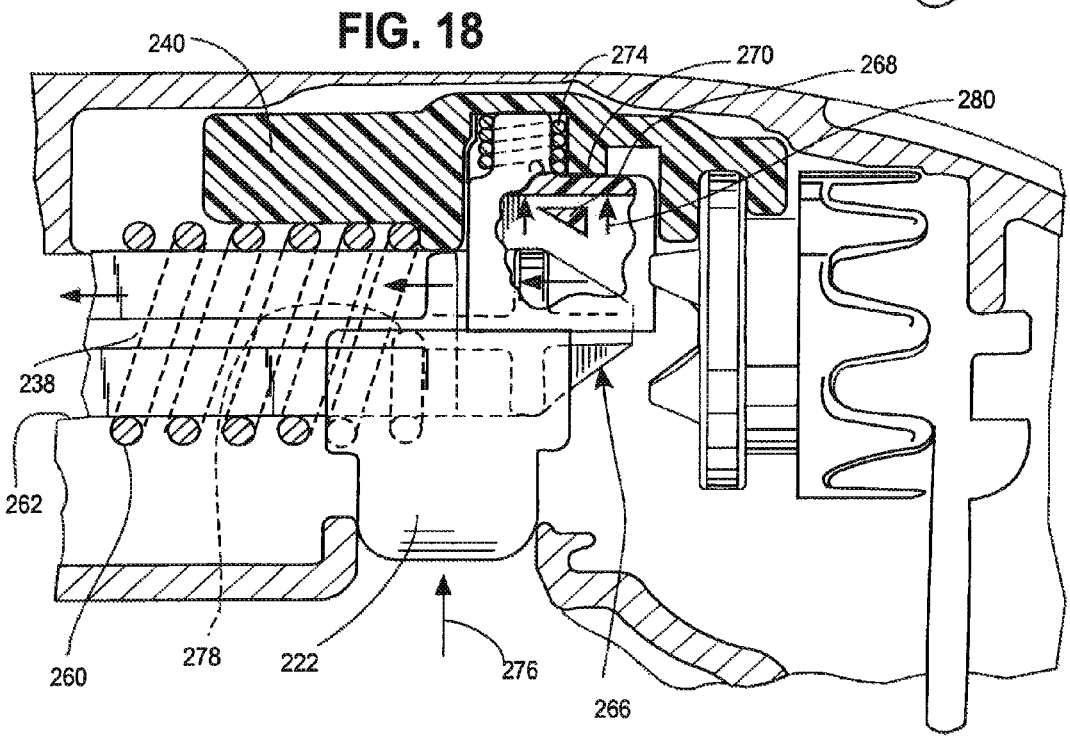

As can be seen in FIGS. 17-18, plunger 238 engages with carriage 240 in substantially the following fashion. A user inserts plunger 238 (which is attached to paint brush head 204) into chamber 262. Plunger is guided toward carriage 240 by the walls of chamber 262.

A catch 264 is formed at the distal end 266 of plunger 238. Catch 264 functions to engage retainer 268, which is illustratively formed integrally with slider 270. Slider 270 is illustratively housed within plunger 238 and is configured to move orthogonally relative to the plunger axis, in the direction indicated by arrow 272. Slider 270 is in communication with button 222 on one end, and is biased by spring 274 on the other end. When button 222 is depressed in the direction shown by arrow 276 (visible in FIG. 18), internal face 278 of button 222 pushes against slider 270, urging it toward spring 274 and eventually causing spring 274 to compress, as shown in FIG. 18. Such movement of slider 270 causes retainer 268 to move upwardly in the direction shown by arrows 280 (FIG. 18), thereby disengaging retainer 268 from catch 264 of plunger 238. In this disengaged position, shown in FIG. 18, plunger 238 can be withdrawn from chamber 262. Such a withdrawal may be appropriate if, for example, a user wants to remove paint brush head 204 and exchange it for another, or clean or dispose of paint brush head 204.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure.

There is a plurality of advantages of the present invention arising from the various features of the paint brush described herein. It will be noted that alternative embodiments of the paint brush of the present invention may not include all of the features described yet still benefit from at least some of the advantages of such features. Those of ordinary skill in the art may readily devise their own implementations of a paint brush that incorporate one or more of the features of the present invention.

What is claimed is:

1. An apparatus comprising:

a paint applicator member coupled to a paint applicator handle, the paint applicator member indexable to a plurality of orientations relative to the paint applicator handle; and a connection mechanism coupling the paint applicator member to the paint applicator handle, the connection mechanism having a spring loaded quick release capable of being manipulated to release the paint applicator member from the paint applicator handle the paint applicator member positionable at a plurality of index locations when the quick release is not manipulated to release the paint applicator member from the paint applicator handle, the connection mechanism includes protrusions formed in a spring loaded first member and a second member, the protrusions operable to be engaged and provide the plurality of orientations.

2. The apparatus of claim 1, wherein the second member further includes an extending stem that engages a lock coupled with the first member.

3. The apparatus of claim 1, wherein the paint applicator member includes an extending stem and the paint applicator handle includes a receiving member located within the paint applicator member and operable to lockingly engage the extending stem.

4. The apparatus of claim 1, wherein the quick release is a button capable of being depressed to release the paint applicator member.

5. The apparatus of claim 4, wherein the paint applicator member can be any one of a brush head, a roller, a pad, a cloth, and a sponge.

6. The apparatus of claim 1, wherein the paint applicator member can be any one of a brush head, a roller, a pad, a cloth, and a sponge.

7. An apparatus comprising:

a paint applicator having a surface capable of applying paint to a painting surface;

a handle that can be selectively engaged and disengaged with the paint applicator and capable of retaining the paint applicator at a plurality of angular orientations, the handle including a retention selector moveable between a first position and a second position and capable of releasing the paint applicator from a locked engagement position so that the paint applicator can be separated from the handle;

a first position member and a second position member having complementary features allowing the first position member to be placed at different angular orientations relative to the second position member, the first position member coupled with a first energy member operable to urge the first position member toward the second position member, the second position member fixed relative to the handle; and a second energy member configured to provide a force to the retention selector when the selector is conveyed from the first position to the second position.

8. The apparatus of claim 7, wherein the paint applicator is capable of being lockingly engaged with and free to rotate relative to the handle.

9. The apparatus of claim 8, wherein a locking device disposed within the handle is operable to be delocked when the retention selector energizes the second energy member.

10. The apparatus of claim 9, wherein the retention selector is a button capable of being depressed to release the paint applicator from the handle.

11. The apparatus of claim 7, wherein the first energy member is a spring.

12. The apparatus of claim 7, which further includes means for gripping the handle, wherein the means can be selected from at least one of a grip-coating and a thumb notch.

13. The apparatus of claim 7, wherein a locking device disposed within the handle is operable to be delocked when the retention selector energizes the second energy member.

14. The apparatus of claim 7, wherein the paint applicator is capable of being lockingly engaged with and free to rotate relative to the handle;

wherein a locking device disposed within the handle is operable to be delocked when the retention selector energizes the second energy member;

wherein the retention selector is a button capable of being depressed to release the paint applicator from the handle; and wherein the first energy member is a spring.

* * * * *